US006053570A

United States Patent [19]

Stern et al.

[11] Patent Number: 6,053,570

[45] Date of Patent: Apr. 25, 2000

[54] DETACHABLE STORAGE DEVICE POSITIONABLE UNDER THEATER SEATS

[76] Inventors: Cindy Jane Stern; Jesse Philip Stern, both of 12 Oaklawn Rd., Summit, N.J. 07901

[21] Appl. No.: 09/082,531

[22] Filed: May 21, 1998

[51] Int. Cl.[7] ..... A47C 7/62

[52] U.S. Cl. ..... 297/188.08; 224/275; 297/188.01; 211/86.01

[58] Field of Search ..... 297/188.08, 188.09, 297/188.12, 188.01, 188.2, 188.06, 464, 468, 485; 224/275, 572; 383/117; D12/416; 211/31, 85.3, 86.01

[56] References Cited

U.S. PATENT DOCUMENTS

| | | | |
|---|---|---|---|
| D. 389,115 | 1/1998 | Alves et al. | D12/416 |
| 623,945 | 4/1899 | Colclazer . | |
| 1,170,448 | 2/1916 | Jennings | 383/117 X |
| 2,390,423 | 12/1945 | Carter | 383/117 X |
| 3,490,507 | 1/1970 | Grashorn | 383/117 X |
| 3,955,849 | 5/1976 | Grebow et al. . | |
| 4,949,842 | 8/1990 | Mokiao, II | 383/117 X |
| 4,984,907 | 1/1991 | Power | 383/117 X |
| 5,015,033 | 5/1991 | Winters . | |
| 5,226,576 | 7/1993 | Ellsworth | 224/275 X |
| 5,401,101 | 3/1995 | Wang | 383/117 X |
| 5,490,623 | 2/1996 | McConnell | 224/275 |
| 5,573,288 | 11/1996 | Raffensberger . | |
| 5,820,210 | 10/1998 | Shipman et al. | 297/188.01 |

FOREIGN PATENT DOCUMENTS

| | | | |
|---|---|---|---|
| 001171746 | 1/1959 | France | 297/188.13 |

*Primary Examiner*—Peter M. Cuomo
*Assistant Examiner*—Stephen Vu
*Attorney, Agent, or Firm*—Jonathan Grant; Grant Patent Services

[57] ABSTRACT

The present invention is for a flexible device attachable to the underside of theater seats, allowing for the storage of personal items. The invention comprises an expandable storage structure, having a bottom section, a top section, a front section, a back section, and side sections, the side sections positioned between the top section and the bottom section and the front section and the back section, said expandable structure having an elasticized opening at the top section, and at least one strap attached to each of the two sides of the expandable structure with each distal end of said at least one strap having a closure mechanism, which is complementary with the other said closure mechanism, thereby allowing the distal ends of said straps to be removably connected.

14 Claims, 3 Drawing Sheets

DETACHABLE STORAGE DEVICE POSITIONABLE UNDER THEATER SEATS

BACKGROUND OF THE INVENTION

1. Field of the Invention

The present invention discloses a flexible storage device attachable to the underside of theater, arena, stadium or auditorium seats, allowing for the storage of personal items.

2. Description of the Prior Art

One of the problems of going to the theater or the movies is where to put coats, hats, or other bulky items during the performance. Laying a heavy overcoat across one's lap is uncomfortable. Hats, gloves, and jackets tend to fall on the floor and get dirty or forgotten. The lack of comfort at the movie house or theater tends to distract from the enjoyment of the evening. Coat check closets take up space in a theater, and slow the movement of the crowds into and out of the theater.

Over the years, there has been a number of attempts to solve the problem of coat and hat storage in the theater by providing storage facilities under the theater seats.

U.S. Pat. No. 5,573,288 (Raffensperger) discloses a portable seat cushion and storage device. This device does show a storage member designed for horizontal placement below a bottom of the seat wherein a top portion of the storage member is interconnected with the connecting member. Unlike the proposed invention, the device of Raffensperger includes a cushion to which the attachment device is connected, as well as a gusset, such that the seat cushion/storage device is essentially a knapsack stored which can be attached to the seat. Also, unlike the present invention, Raffensperger requires a connecting member to wrap around the entire seat, and connect with the storage member, thereby suspending the storage member under the seat.

U.S. Pat. No. 5,015,033 (Winters) discloses an underseat receptacle in which the receptacle is attached by means of screws, clamps, rivets or the like, to the underside of any chair having space available beneath its seat. Unlike the proposed invention, the device is not readily detachable, attachment means is semi-permanent, and there is no basket-like arrangement for storage.

U.S. Pat. No. 623,945 (S. E. Colclazer) discloses a hat holder for seats. It does not have straps, the seats are not removable, and the there is no net or flexible webbing.

U.S. Pat. No. 3,955,849 (Grebow et al.) discloses storage pockets provided on the sides of beach chair chairs for accessories. A net or mesh extends across the bottom of the chair to form an article holding beach bag and to allow the sand to escape when the chair is lifted.

SUMMARY OF THE INVENTION

The proposed invention is an effective, inexpensive solution to the age old problem of where to put coats and other bulky items when attending the theater, ball games, or any other area of public assembly where there are flip down seats. The device is a flexible and durable unit located underneath movie or theater seats. The device is much less costly and less complex than the prior art, and allows for easy connection and removal from the theater seat. More specifically, the invention is easily attached to the bottom of the flip down seat without defacing or causing any damage to the existing seat. The device is designed to allow for maximum storage space to fit coats and other personal items. The flexible netting expands to allow for an increased storage area when in use, while the water-repellant base fabric keeps the enclosed items clean and protected.

The detachable article storage device comprises an expandable structure having a bottom section, a top section, a front section, a back section, and side sections, with the structure having an elasticized opening at the top section. Each of the two sides of the storage device has attached to it at least one strap with each end of the strap having a buckle or other closure mechanism. In a preferred embodiment of the invention, there are at least two, and preferably three straps attached to each of the side sections, with each of the straps having a buckle or closure mechanism, with a complementary closure mechanism positioned on the end of the complementary strap.

In one embodiment of the invention the top section of the article storage device is comprised of an expandable netted fabric mesh. Other expandable materials may be used, In another embodiment of the invention, the top section of the article storage device is comprised of a solid material or fabric.

In a preferred embodiment of the invention, the device has a flexible cloth bottom section to which the expandable netted fabric is attached. In yet another embodiment, the bottom section may be a semi-rigid plastic piece, having a bottom section, a front section a back section, and side sections, into which the netted fabric is fitted.

The expandable netting may encase a wire frame, thereby giving the storage device form.

BRIEF DESCRIPTION OF THE DRAWINGS

The above and other objects, features and advantages of the present invention will become more readily apparent from the following description, reference being made to the accompanying drawings in which.

DESCRIPTION OF THE PREFERRED EMBODIMENT

Figure 1:
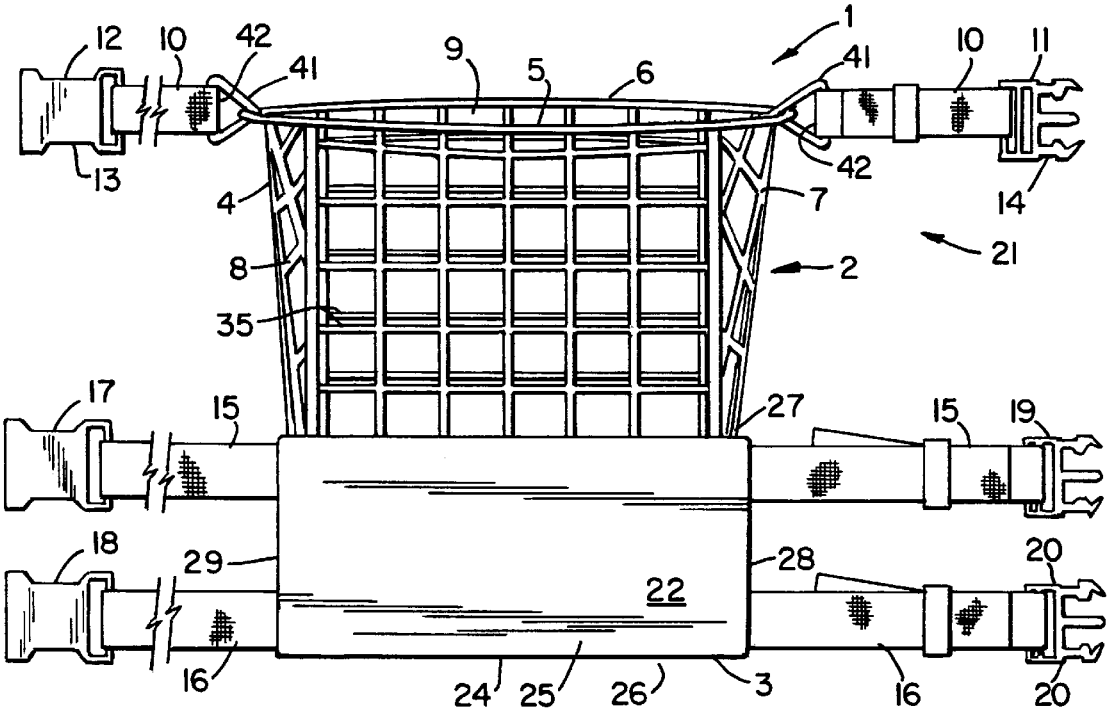
FIG. 1 is a frontal view of one embodiment of the present invention.
Figure 2:
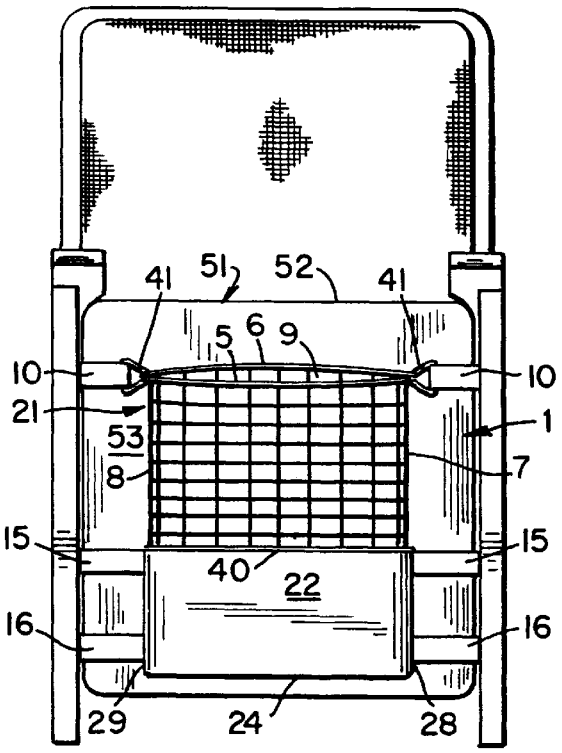
FIG. 2 is a frontal view of the storage device attached to a theater seat.
Figure 3:
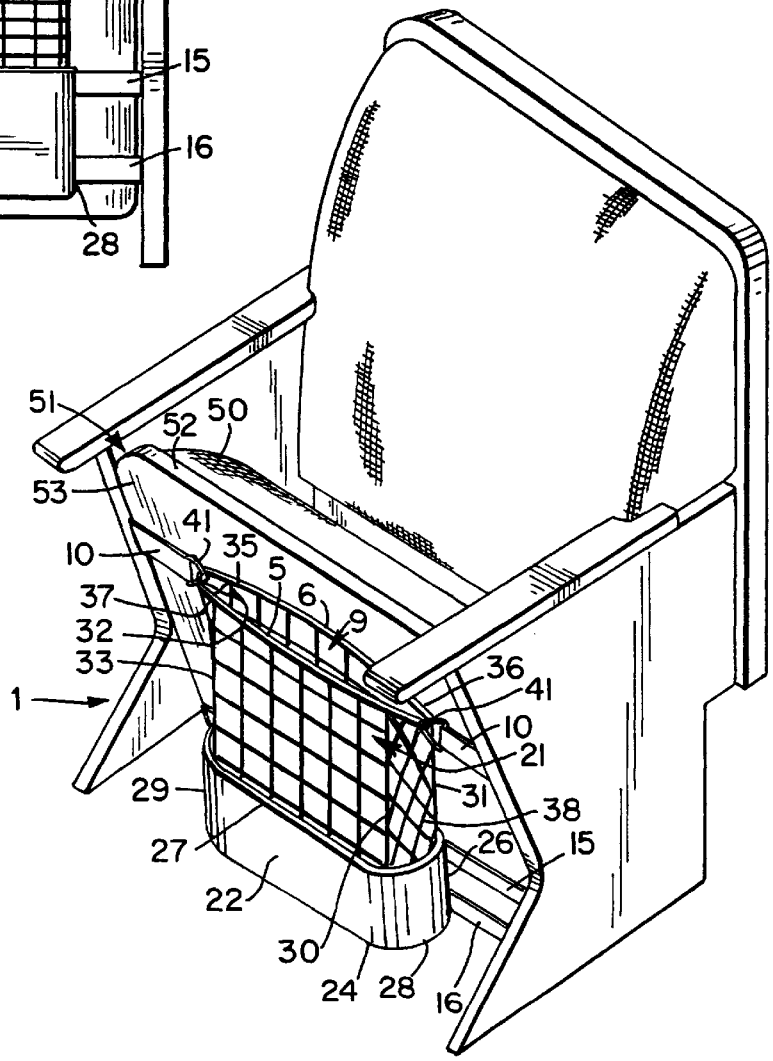
FIG. 3 is an angular overhead view of the storage device attached to a theater seat.
Figure 4:
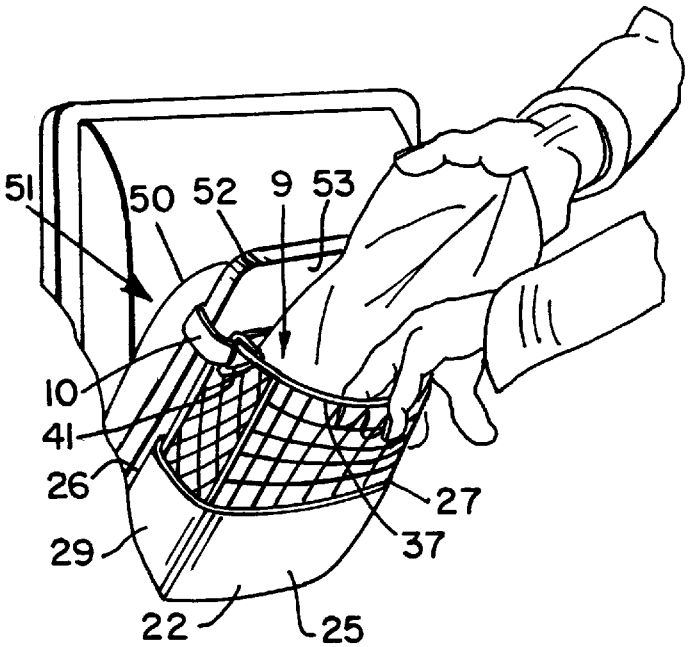
FIG. 4 is an angular view showing the storage device in use.
Figure 5:
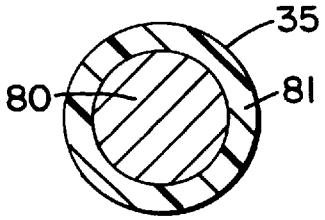
FIG. 5 is a cross-section of one of the supports.
Figure 6:
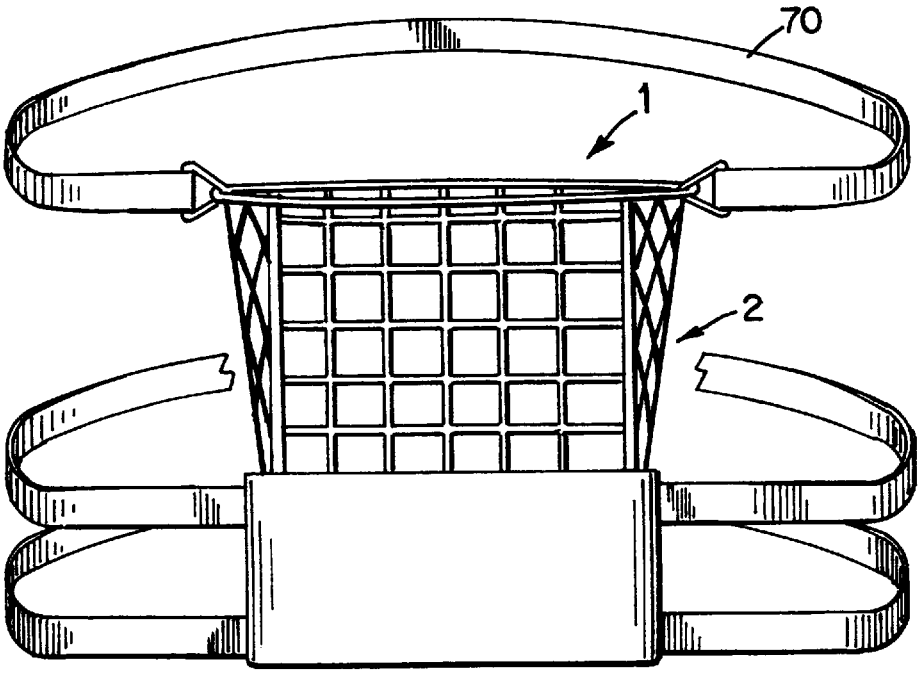
FIG. 6 shows the attachment of the straps to the storage device.

Referring to FIGS. 1–4, the storage device 1 comprises a structure 2, preferably expandable, which has a bottom section 3, a top section 4, a front section 5, a back section 6, and side sections 7 and 8. The side section 7 and 8 are approximately parallel with each other. The expandable structure 2, has an expandableopening 9 at the top section 4.

At least one strap 10, made out of cloth, nylon, leather, expandable or any other appropriate material, is attached to each of the two side sections 7 and 8 of the expandable structure,. Each distal end 11 and 12 of the strap 10 has a buckle, clasp or other closure mechanism, with one distal end 11 of the strap attached to one side section 7 have a closure mechanism 13 which is complementary to the closure mechanism 14 on the distal end 12 of the strap attached to the other side section 8 of the storage device 1. In a preferred embodiment of the invention, there are at least two, and preferably three, straps 15, 16, attached to each of the two side sections, with each of the straps 10, 15, 16, having a buckle or closure mechanism, 13, 17, 18, with a complementary closure mechanism 14, 19, 20 positioned on the end of the complementary strap.

In one embodiment of the invention, the upper section 21 of the article storage device 1 is comprised of an expandable netted fabric. In another embodiment of the invention, the upper section 21 may be comprised of a solid material or fabric.

In a preferred embodiment of the storage device 1, the device has a flexible cloth lower section 22 to which the nylon wire mesh is attached. In yet another embodiment, the lower section 22 may be a semi-rigid plastic piece, having a bottom section 24, a front section 25, a back section 26, a top section 27 and side sections 28 and 29, into which the expandable netted fabric part of the storage device is fitted. The expandable netted fabric part of the storage device may be attached by an adhesive, by rivets, by stitching, or by any other conventional means of attachment, such that the netted mesh fabric part of the storage device does not separate from the lower section of the device. In yet another alternative means of attachment, the upper section of the storage device is fitted snugly into the lower section of the storage device.

In one embodiment of the invention, the storage device may have a degree of rigidity so that the general shape of the device may be kept. Specifically, longitudinal pieces 30, 31, 32, and 33 located at the which run the length of the device may be metal pieces 34 surrounded by a cloth-like and/or expandable material. Similarly, the latitudinal support rods 35 may also be metal or plastic pieces 80 surrounded by a cloth-like and/or expandable material 81. In an alternative embodiment, the latitudinal support rods 35 may be made of a tightly woven expandable material which has a minimum amount of contraction, but which, when pulled or tugged, has a maximum degree of expandibility. A cross-sectional rod 36 at or near the top section 4 and transversing the two side sections 7 and 8 further gives the storage device 1 body. It is preferred that the cross-sectional rod 36 be positioned on the back section 6 of the structure 2. It is also preferred that the top section 4 of the structure have an elasticized opening 9, preferably with an extra expandable band of material 37 of material at the opening 9, thereby assisting in the securing of any goods placed inside the structure 2 by the theater patron.

In yet another preferred embodiment, diagonally criss-crossing expandable pieces 38 on the sides 7 and 8 connect the front section 5 and the back section 6 of the structure 2. In this embodiment, the longitudinal and latitudinal bars 39 which comprise the front and back sections may either be flexible or may be made of a more rigid material. Additionally, the front section 5 and the back section 6 may be connected at a common bottom edge 40 or the two sections may remain "separated" by the side sections, with the bottom section 3 preventing the customer's goods from falling out of the structure 2

As previously mentioned, it is preferred that there are preferably at least two, and most preferably, three sets of straps 10 attached to the storage device 1 which secure the structure 2 to the theater or flip up seat. The straps 10 at or near the top of the structure 2 are attached by clips or connectors 41 slipped through the proximal ends 42 of the strap, to the frame-like structure 2 of the storage device 1. The proximal ends of the straps may be connected to virtually any part of side sections 7 and 8. It is preferred that the opposing straps be positioned at approximately the same latitude.

There are a variety of ways in which the straps are attached to the bottom section 24 of the device 1. The straps 15 and 16 may be fitted through openings 43 and 44 in the lower section 22. In another embodiment of the invention, the straps 15 and 16 may be sewn or attached by adhesive to the back of the lower section 22.

In another embodiment of the invention, there are no buckles or locking mechanisms in or on the straps 10, 15, or 16. Instead, the straps 70 are continuous without a buckle arrangement, so only the ends of the straps are connected to the sides of the storage device 1.

In another preferred embodiment of the invention, the storage device is treated with a conventional, state-of-the-art, flame retardant.

The attachment of the storage device to a conventional theater seat is simple. The theater owner pops the cushion part 50 of the theater seat 51 out of the seat frame 52. The storage device is placed on the underside 53 of the seat frame with the back section 6 of the storage device 1 facing the underside 53 of the theater seat 51. The straps 10, 15, 16, fit around the seat frame 52 and are buckled. The cushion part 50 is then snapped back into the theater seat 51.

This device may be used with chairs and theater seats without pop-out cushions. Some theater seat cushions may be removed by unscrewing the seat cushion, while other seats, such as at stadiums, do not have cushions at all.

Many modifications and variations of the present invention are possible in light of the above teachings. It is, therefore, to be understood within the scope of the appended claims the invention may be protected otherwise than as specifically described.

What is claimed is:

1. A detachable storage device for attachment under a flip up seat, comprising:

an expandable storage structure, said expandable structure having a bottom section, a top section, a front section, a back section, and side sections, said side sections positioned between the top section and the bottom section and the front section and the back section, said expandable structure having an elasticized opening at the top section;

at least one strap attached to each of said two sides of said expandable structure with each distal end of said at least one strap having a complementary closure mechanism, thereby allowing the distal ends of said straps to be removably connected, said at least one strap being attachable to an underside of a flip up section of a flip up seat by positioning said strap over the flip of seat, such that when said detachable storage device is attached to said flip up seat, said expandable opening at the top section of said detachable storage device is facing outwardly from a front section of said flip up chair.

2. The detachable storage device of claim 1, further comprising at least two said straps attached to each of said side sections.

3. The detachable storage device of claim 1, wherein the detachable storage device further comprises an upper section and a lower section.

4. The detachable storage device of claim 3, wherein the upper section of the article storage device is comprised of an expandable netted fabric.

5. The detachable storage device of claim 1, wherein the top section of the article storage device is comprised of a solid material.

6. The detachable storage device of claim 1, wherein the device has a flexible cloth lower section to which the expandable netted fabric is attached.

7. The detachable storage device of claim 1, wherein the lower section is a semi-rigid plastic piece to which the expandable netted fabric is fitted.

8. The detachable storage device of claim 1, wherein the expandable netted fabric encases a wire frame, thereby giving said storage device form.

9. The detachable storage device of claim 1, wherein said storage device has a degree of rigidity so that the general shape of the device is kept.

10. The detachable storage device of claim 1, further comprising rigid pieces surrounded by a flexible material, said rigid pieces positioned along a length of said detachable storage device, along said both sides of said detachable storage device.

11. The detachable storage device of claim 1, further comprising latitudinal support rods surrounded by a flexible material positioned and connecting each of said two sides in a same plane.

12. The detachable storage device of claim 11, wherein the latitudinal support rods are comprised of a tightly woven expandable material which has a minimum amount of contraction, but which, when pulled or tugged, has a maximum degree of expandibility.

13. The detachable storage device of claim 12, further comprising a cross-sectional rod near the top section and positioned on the back section of the storage device, transversing the two side sections, further giving the storage device body.

14. A detachable storage device for attachment under a flip up seat, an expandable storage structure, said expandable structure having a bottom section, a top section, a front section, a back section, and side sections, said side sections positioned between the top section and the bottom section and the front section and the back section, said expandable structure having a flexible and expandable opening at the top section;

at least one strap, said strap having opposite ends, each of said opposite ends of said at least one strap being attached to one of said two sides of said expandable structure with each distal end of said at least one strap having a complimentary closure mechanism, thereby allowing the distal ends of said straps to be removably connected, said at least one strap being attachable to an underside of a flip up section of a flip up seat by positioning said strap over the flip of seat, such that when said detachable storage device is attached to said flip up seat, said expandable opening at the top section of said detachable storage device is facing outwardly from a front section of said flip up chair.

* * * * *